United States Patent [19]

Daux

[11] Patent Number: 4,720,238

[45] Date of Patent: Jan. 19, 1988

[54] METHOD OF INTERFACING MECHANICAL AND CONCRETE COMPONENTS OF A PUMP COMPRISING A CONCRETE VOLUTE, AND CORRESPONDING PUMP

[75] Inventor: Jean-Pierre Daux, Mandres les Roses, France

[73] Assignee: Bergeron, Societe Anonyme, Paris, France

[21] Appl. No.: 3,294

[22] Filed: Jan. 14, 1987

[30] Foreign Application Priority Data

Jan. 20, 1986 [FR] France ..... 86 00685

[51] Int. Cl.[4] ..... F03B 11/02; F04D 29/08

[52] U.S. Cl. ..... 415/170 A; 415/219 C; 52/252; 52/253

[58] Field of Search ..... 415/219 C, 200, 170 A; 52/251, 252, 253

[56] References Cited

U.S. PATENT DOCUMENTS

| | | | |
|---|---|---|---|
| 2,161,177 | 6/1939 | Leisner | 52/251 |
| 2,529,880 | 11/1950 | McClure | 415/219 C |
| 3,186,685 | 6/1965 | Chatfield | 415/219 C |
| 3,779,667 | 12/1973 | Johnson | 415/170 A |
| 4,245,952 | 1/1981 | Eberhardt | 415/170 A |

*Primary Examiner*—Albert J. Makay
*Assistant Examiner*—David W. Westphal

[57] ABSTRACT

A method of interfacing mechanical and concrete components of a pump comprising a concrete volute entails simultaneously placing two metal rings in recesses provided in a suction orifice and in a well of the volute of the pump. This is done using a jig having two molding surfaces spaced from each other by a predetermined axial distance and placed at a position near the rings. Each of the rings is embedded in a hardenable resin which is molded by the two molding surfaces on the jig. This forms two annular resin blocks having molded surfaces. These molded surfaces are used as respective support surfaces for a sealing ring and for a cover in which the rotor of the pump is rotatably mounted.

6 Claims, 17 Drawing Figures

METHOD OF INTERFACING MECHANICAL AND CONCRETE COMPONENTS OF A PUMP COMPRISING A CONCRETE VOLUTE, AND CORRESPONDING PUMP

BACKGROUND OF THE INVENTION

1. Field of the Invention

The present invention concerns a method of interfacing mechanical and concrete components of a pump comprising a concrete volute, having an axial suction orifice in its lower part and a well in its upper part substantially coaxial with said suction orifice, coaxial upper and lower metal rings, which are fixed in respective recesses provided in the concrete of said well and of said suction orifice, respectively, a sealing ring removably attached to said lower ring, a metal cover having an edge removably attached to said upper ring, a vertical shaft supported axially and rotatably mounted on said cover, and a rotor attached to a lower end of said shaft and having a part facing said sealing ring with a small clearance between them.

2. Desription of the Prior Art

In volute pumps of routine sizes the volute is generally of metal, usually a casting. Beyond a certain size it may be more economical to make the volute from concrete, however, either using formwork, of wood for example, the outside shape of which corresponds to the inside shape of the spiral conduit of the volute, or using prefabricated concrete components which are assembled on site and which, once fitted together, form the volute. In either case concrete is cast around the formwork or the prefabricated components to form the infrastructure of the pumping station (and simultaneously forming the volute in the case where formwork is used).

The best manufacturing and positioning tolerances that can be achieved in civil engineering works are plus or minus 1 cm. These tolerances are incompatible with the tolerances for positioning the mechanical components of the pump, especially the tolerances for positioning the rotor of the pump relative to the stator. For example, the clearance between the sealing ring and the part of the rotor facing said sealing ring has to be in the order of 1 mm. Thus it is not possible to fix the sealing ring and the cover of the pump, which supports the shaft and the rotor, directly to the concrete, in the suction orifice and in the well of the volute, respectively. This is why, in known concrete volute pumps, the sealing ring and the cover are respectively fixed to a lower metal ring and an upper metal ring that have to be embedded in the suction orifice and in the well of the volute, respectively, at extremely precise position, the lower and upper rings forming the interfaces between the concrete volute and the mechanical components of the pump. To this end, during a first phase the lower ring is first positioned relative to the axis of the volute suction orifice and is then wedged approximately in terms of height and level (horizontality). In this position tie rods for anchoring the lower ring are embedded in the concrete.

During a second phase, and using the cover and the rotor of the pump as a jig, the lower ring is then wedged and finally adjusted relative to the geometrical axis of the pump, on the one hand, and the upper ring is wedged and then finally adjusted relative to the lower ring, on the other hand. During a third phase the lower and upper rings are definitely fixed to the concrete. These successive operations of adjusting and fixing the two rings entail masonry works that are also executed in stages, namely:

embedding the tie rods used to anchor the lower ring;

final fixing of the lower ring and finishing off with the inside wall of the volute suction orifice;

final fixing of the upper ring and finishing off with the inside wall of the volute well.

These successive operations entailing works of different kinds (masonry and mechanical adjustments) have the disadvantage of requiring repeated and alternating deployment of differently skilled workforces.

Also, in known concrete volute pumps the sealing ring and the cover are supported directly by the lower ring and by the upper ring, respectively. As a consequence of this, apart from the fact that the two rings have to be positioned in a precise manner (with a tolerance of 1 mm or better), they have also to be machined so as to have surfaces of an appropriate shape and with an appropriate surface finish to receive the sealing ring and the pump cover, respectively. These machining operations are relatively complex and costly, given that, here again, the machining tolerances are in the order of 1 mm or better and in that the two rings are relatively large. The diameter of the lower ring depends on the suction diameter of the pump rotor and that of the upper ring depends on the outside diameter of the rotor. To give an idea of the magnitudes involved, these diameters routinely vary between 1.5 m and 4 m.

An objective of the present invention is to propose a method executing, as a single operation and simultaneously, fitting of the lower and upper rings and the formation of mechanical support surfaces adapted to receive the removable components of the pump (sealing ring and cover), without it being necessary to call in specialists in other disciplines than mechanical engineering and without it being necessary to use precisely machined rings.

SUMMARY OF THE INVENTION

The present invention consists in a method of interfacing mechanical and concrete components of a pump comprising a concrete volute having an axial suction orifice in its lower part and a well in its upper part substantially coaxial with said suction orifice, coaxial upper and lower metal rings, which are fixed in respective recesses provided in the concrete of said well and of said suction orifice, a sealing ring removably attached to said lower ring, a metal cover having an edge removably attached to said upper ring, a vertical shaft supported axially and rotatably mounted on said cover, and a rotor attached to a lower end of said shaft and having a part facing said sealing ring with a small clearance between them, in which method said upper and lower rings are placed simultaneously in the respective recess, each ring is encapsulated with a hardenable resin which is shaped by means of a single mold having upper and lower molding surfaces coaxial with and spaced from each other at an axial distance corresponding to the vertical distance between said edge of said cover and said sealing ring so as to form, once said resin has set, upper and lower annular blocks of resin reinforced by said metal rings and having molded surfaces corresponding to said molding surfaces of said mold and respectively serving to support said cover and said sealing ring.

Other characteristics and advantages of the present invention will emerge more clearly from the following description given with reference to the appended drawings.

DESCRIPTION OF THE PREFERRED EMBODIMENTS

Figure 1:
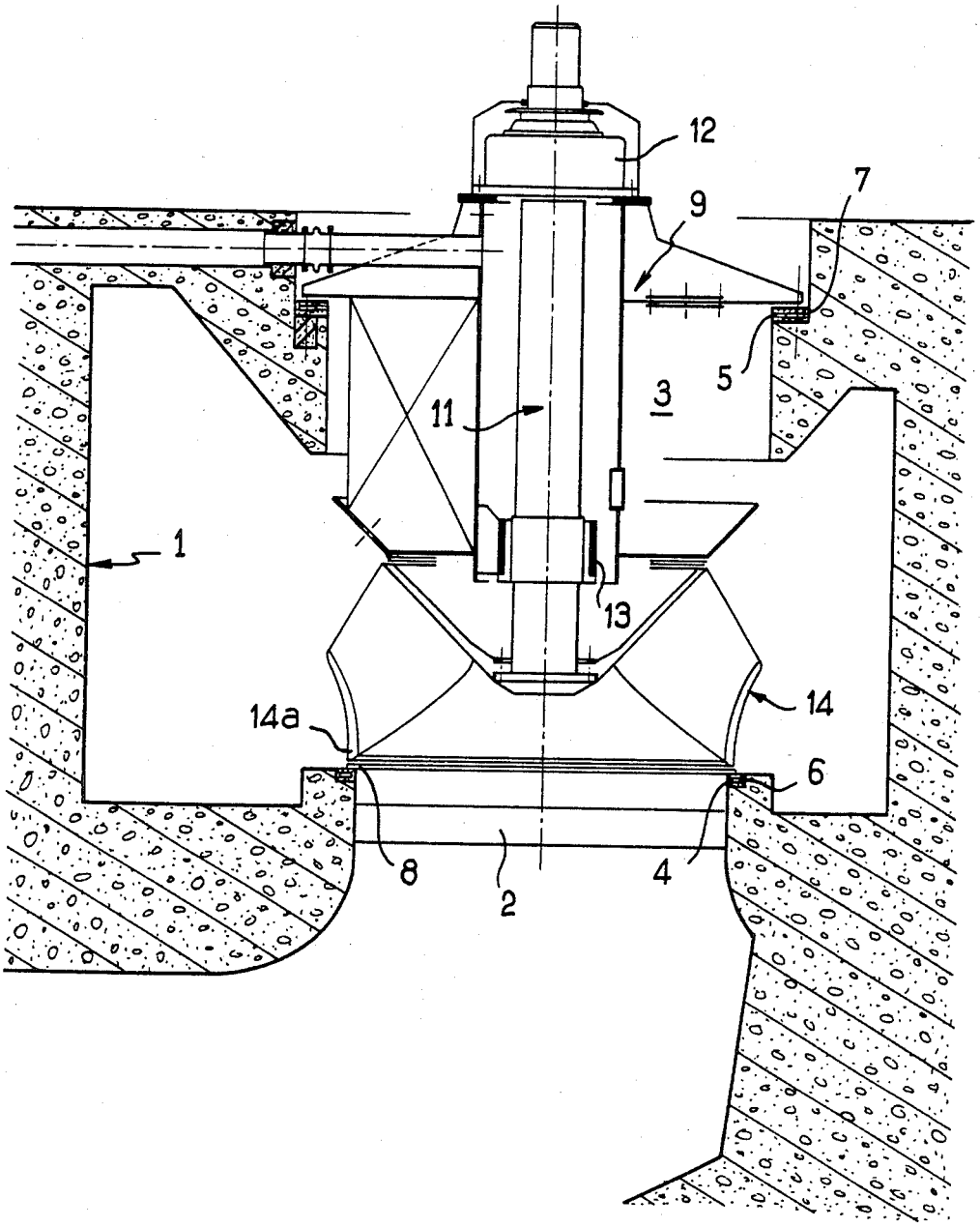
FIG. 1 is a view in vertical cross-section of a concrete volute pump.

As shown in FIG. 1, the pump essentially comprises a concrete volute 1 comprising an axial suction orifice 2 and a well 3 which is substantially coaxial with the suction orifice 2; a lower metal ring 4 and an upper metal ring 5 which are embedded in respective recesses 6 and 7 provided in the concrete walls of the suction orifice 2 and the well 3; a sealing ring 8 of metal, bronze for example, or plastics materials, removably attached to the ring 4; a metal cover 9, also known as the pump body backing member, removably attached to the ring 5; a shaft 11 which is supported axially and rotatably mounted on the cover 9 through the intermediary of bearings 12 and 13; and a rotor 14 which is fixed to the lower end of the shaft 11 and the lower part 14*a* of which faces the sealing ring 8 with a small clearance (approximately 1 mm) between it and the latter.

Figure 2:
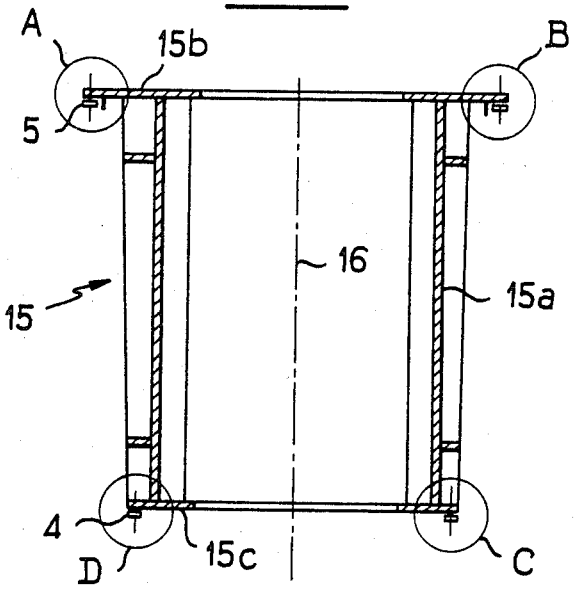
FIG. 2 is a view in vertical cross-section of a jig usable to implement the method of the invention.

FIG. 2 shows a jig 15 that can be used for positioning and embedding the two rings 4 and 5 in the recesses 6 and 7, respectively. The jig 15 comprises a cylindrical barrel 15*a* to the ends of which are fixed, as by welding, for example, annular flanges 15*b* and 15*c*. The outside peripheral part of the lower surface of the flange 15*b* is machined to form a molding surface 15*d* (FIGS. 3 and 4) which is plane and perpendicular to the longitudinal axis 16 of the jig 15. Also, as shown in FIGS. 3 and 4, a cylindrical skirt 15*e* the diameter of which is smaller than the outside diameter of the flange 15*b* is welded to the lower surface of said flange concentrically with the axis 16.

Figure 6:
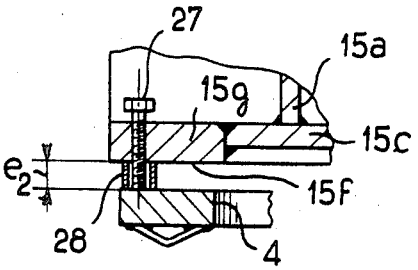
Figure 5:
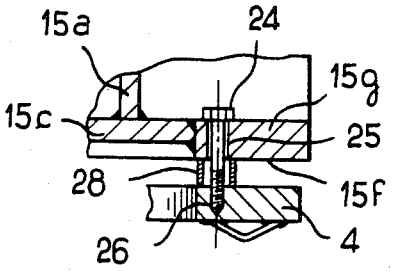

Similarly, the outside peripheral area of the lower surface of the flange 15*c* is machined to form a molding surface 15*f* (FIG. 5 and 6) which is plane and perpendicular to the axis 16. As shown in FIGS. 5 and 6, the surface 15*f* can form part of a ring 15*g* welded to the edge of the flange 15*c*. The two molding surfaces 15*d* and 15*f* are coaxial with the axis 16 and spaced axially from each other by a predetermined distance corresponding to the vertical distance between the cover 9 and the sealing ring 8.

Figure 3:
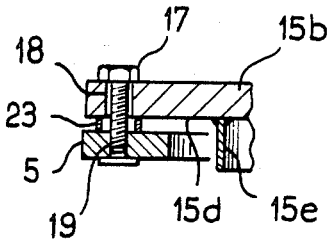
FIGS. 3 through 6 are views showing to a larger scale the respective details marked A, B, C and D in FIG. 2.
Figure 4:
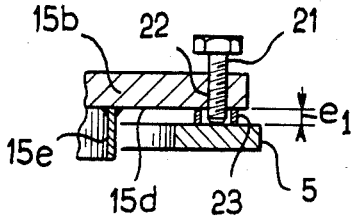

The ring 5 of the pump is removably attached to the flange 15*b* by various tension screws 17 such as that shown in FIG. 3, which pass freely through holes 18 in the flange 15*b* and are screwed into threaded holes 19 in the ring 5. The axes of the holes 18 are situated on a circle centered on the axis 16 of the jig 15. A gap $e_1$ of between one and a few centimetres is provided between the ring 5 and the flange 15*b* by means of a small number (three, for example) thrust screws 21 such as that shown in FIG. 4, which are screwed into threaded holes 22 in the flange 15*b* and bear against the upper surface of the ring 5. Sealing rings 23, of rubber, for example, are disposed around each of the screws 17 and 21. By choosing rings 23 having sufficient stiffness in the axial direction, the rings 23 could equally well serve as spacing rings between the ring 5 and the flange 15*b*, in which case the thrust screws 21 could be dispensed with.

Similarly, the ring 4 of the pump is removably attached to the outside ring 15*g* of the flange 15*c* by means of a number of tension screws 24 such as that shown in FIG. 5 which pass freely through holes 25 in the ring 15*g* and are screwed into threaded holes 26 in the ring 4. The axes of the holes 25 are situated on a circle centered on the axis 16 of the jig 15. A gap $e_2$ of between one and a few centimetres is provided between the ring 4 and the ring 15*g* by a few thrust screws 27 such as that shown in FIG. 6 and/or by sealing and spacing rings 28 disposed around each of the screws 24 and 27 (FIGS. 5 and 6).

Figure 7:
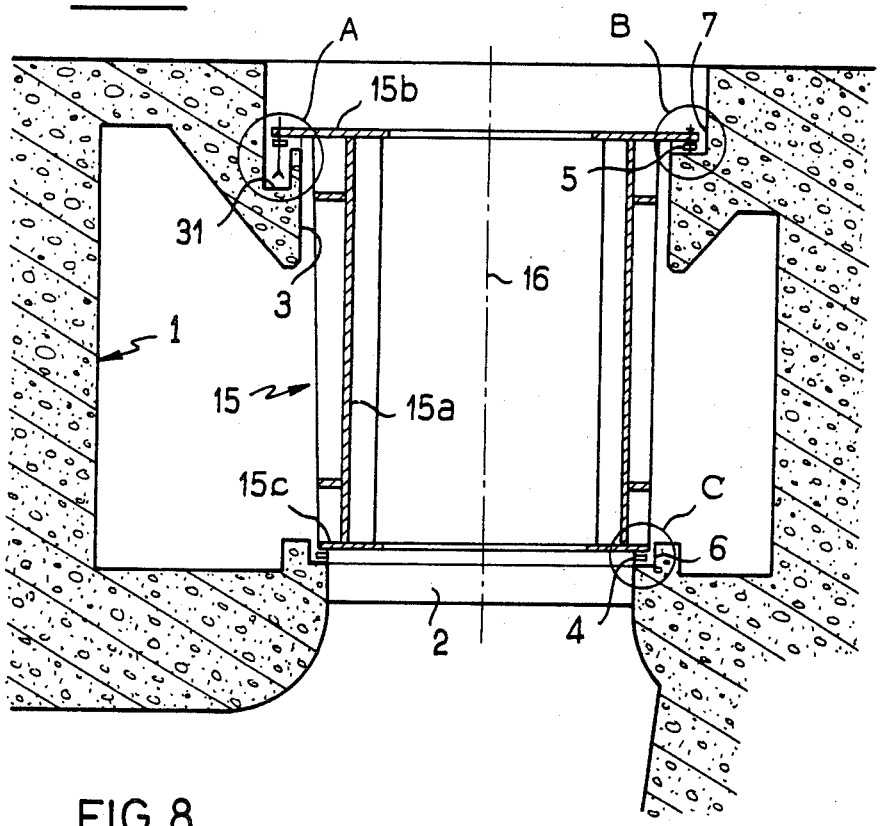
FIG. 7 is a view in vertical cross-section showing the jig from FIG. 2 installed in the volute of the pump.
Figure 8:
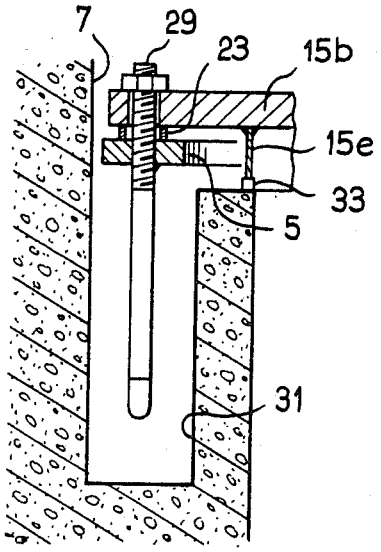
FIGS. 8 and 9 are views respectively showing to a larger scale the details marked A and B in FIG. 7.
Figure 9:
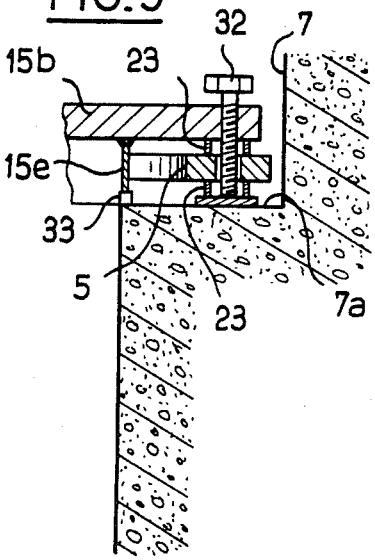

After the rings 4 and 5 have been fixed to the flanges 15*c* and 15*b*, respectively, in the manner described above, the jig 15 is lowered through the well 3 of the volute 1 until the rings 4 and 5 are respectively level with the recesses 6 and 7 provided in the wall of the suction orifice 2 and in the wall of the well 3, respectively, as shown in FIG. 7. The jig 15 is disposed in such a way that its axis 16 coincides with the axis of the suction orifice 2 and so that the tie rods 29 used to anchor the ring 5 are positioned in the holes 31 provided for them (FIG. 7, detail A and FIG. 8). The jig 15 bears on the annular shoulder 7*a* of the recess 7 through the intermediary of screw jacks 32 such as that shown in FIG. 9, there being three screw jacks, for example, spaced by 120° at the edge of the flange 15*b*. Like the screws 21 and 17, the threaded parts of the anchor tie rods 29 and of the screw jacks 32 are protected by sealing and/or spacing rings 23 (FIGS. 8 and 9). The jig 15 is then adjusted in terms of height and levelled by means of the screw jacks 32. A sealing bead 33 (FIGS. 8 and 9) is laid between the lower end of the skirt 15*e* and the shoulder 7*a* of the recess 7. Rather than providing a sealing bead 33, the skirt 15*e* could be made of rubber or its lower edge could be fitted beforehand with a rubber sealing ring.

Figure 10:
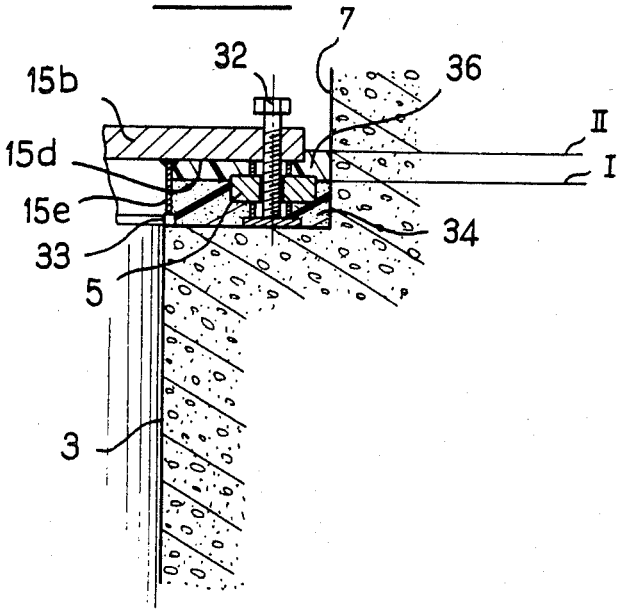
FIGS. 10 and 11 respectively show to a larger scale the details marked B and C in FIG. 7 and respectively illustrate the embedding of the upper and lower rings of the pump.
Figure 11:
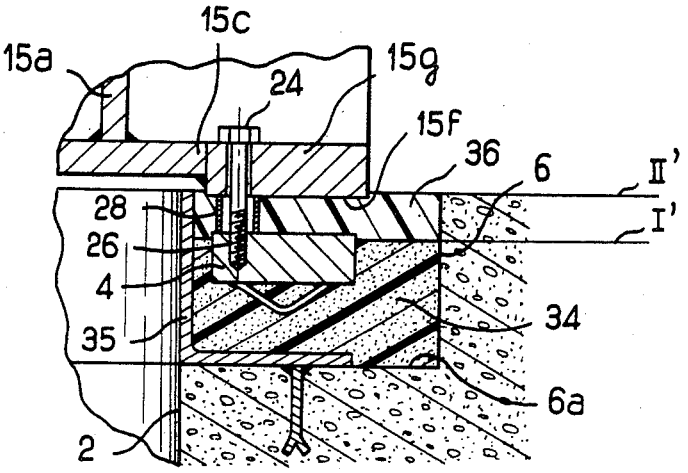

A resin mortar 34 is then cast into the holes 31 and into the recess 7 up to a level I (FIG. 10) such that the ring 5 is at least partially embedded in the resin mortar. The skirt 15*e* and the bead 33 prevent the resin mortar from flowing into the well 3. Resin mortar 34 is also cast into the recess 6 up to a level I' (FIG. 11) such that the ring 4 is at least partially embedded in the resin mortar. An annular retaining member 35 of L-shaped cross-section, the inside diameter of which corresponds to that of the suction orifice 2 and which is previously fixed to the annular shoulder 6*a* of the recess 6, prevents the resin mortar from flowing into the suction orifice 2.

After the resin mortar 34 has set, a hardenable resin 36 is cast into the recess 7 up to a level II (FIG. 10) and into the recess 6 up to a level II' (FIG. 11) such that the rings 4 and 5 are completely embedded and there are obtained two annular blocks of resin the upper surfaces of which are molded by the molding surfaces 15*d* and 15*f*, previously coated with an anti-adhesion agent. After the resin 36 has hardened, the screws 17 and 24 and the nuts of the anchor tie rods 29 are removed. Note that during the casting of the resin mortar 34 and during the casting of the resin 36 the screws 17, 21, 24, 27 and 32 and the threaded part of the anchor tie rods 29 were protected against contact with the resin mortar or the resin so that the screws 17 and 24 can be easily unscrewed to detach the jig 15 from the two rings 4 and 5. The jig 15 can then be lifted out of the well 3 of the volute 1.

Figure 12:
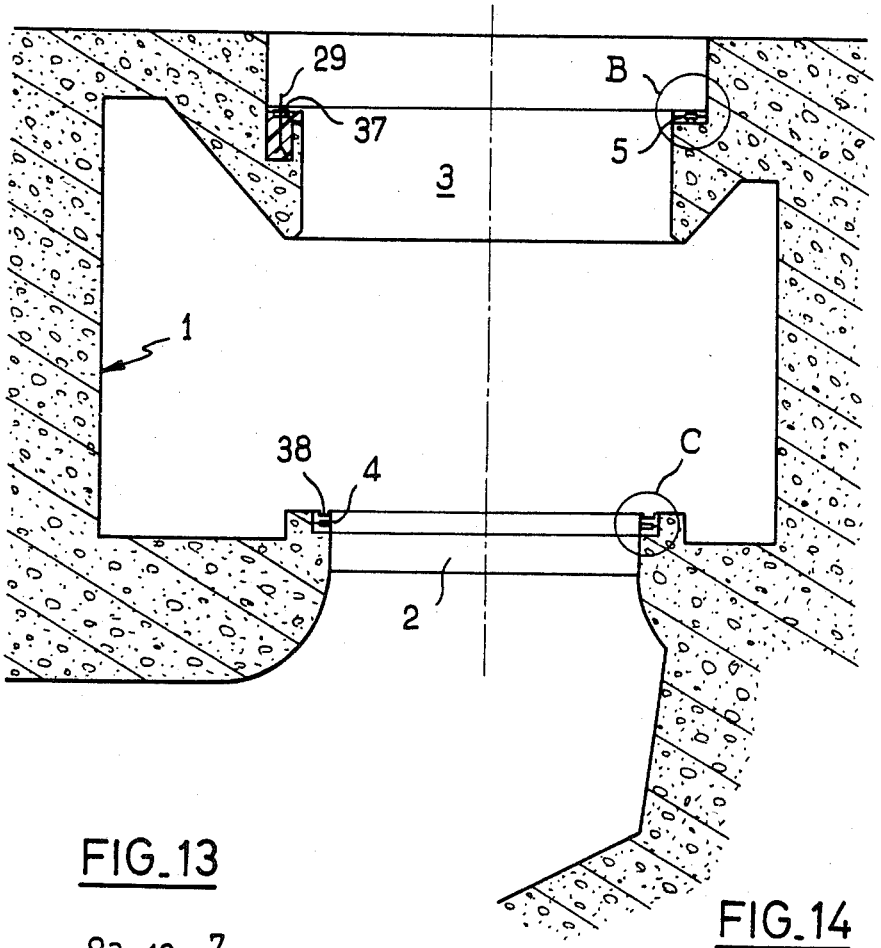
FIG. 12 is a view similar to FIG. 7 after embedding the upper and lower rings of the pump and following removal of the jig.
Figure 13:
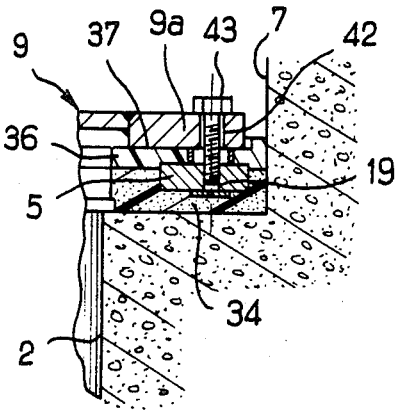
FIGS. 13 and 14 respectively show to a larger scale the details marked B and C in FIG. 12, after fixing the cover and the sealing ring respectively to the upper ring and to the lower ring of the pump.
Figure 14:
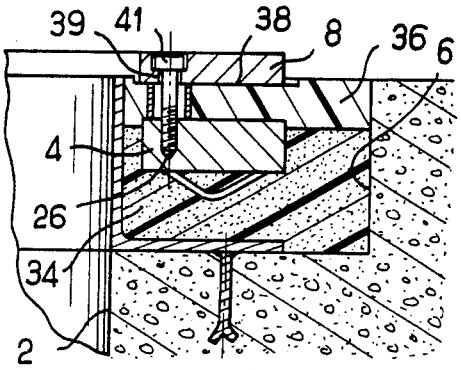

The resin 36 is chosen to feature high hardness and a good surface state after removal of the mold, that is to say after removal of the jig 15. The resin 36 may be, for example, a CHOCKFAST ORANGE resin as manufactured by the PHILADELPHIA RESIN Corporation. The resin mortar may be, for example, a CHOCKFAST BLUE or CHOCKFAST RED mortar manufactured by the same Corporation. Following removal of the mold, there are obtained two annular blocks whose molded upper surfaces 37 and 38 (FIG. 12) are perfectly coaxial and spaced axially from each other by a predetermined distance corresponding to the vertical distance between the cover 9 and the sealing ring 8 of the pump. The sealing ring 8 is then laid onto the molded surface 38 of the resin block 36, the holes 39 in the ring 8 are aligned with the threaded holes 26 in the ring 4 and the ring 8 is fixed to the ring 4 by screws 41 as shown in FIG. 14. The assembly 9–14 is then lowered as a whole or in parts through the well 3 of the volute 1. The cover 9 comprises in its peripheral region 9*a* holes 42 the number of which corresponds to the total number of threaded holes 19 and anchor tie bolts 9 of the ring 5. Before the cover 9 is laid on the molded surface 37, the holes 42 are aligned with the anchor tie rods 29 and with the threaded holes 19 in the ring 5 and the threaded parts of the anchor tie rods 29 are then inserted through the corresponding holes 42 and the cover 9 is laid on the molded surface 37. The cover 9 is then fixed to the ring 5 by means of screws 43 which are screwed into the threaded holes 19 and by means of nuts which are screwed onto the anchor tie rods 29.

From the foregoing description it is clear that the two rings 4 and 5 of the pump are positioned and centered in an operation that is much simpler and much faster than previously by virtue of the use of the jig 15 and that the two rings 4 and 5 may be fixed at the same time, without calling in masons, by the mechanical engineers responsible for installing the mechanical components of the pump. Also, given that the sealing ring 8 and the cover 9 are no longer supported directly by the rings 4 and 5, respectively, but rather by the respective molded surfaces 38 and 37, the rings 4 and 5 no longer need to be accurately positioned relative to each other in the axial direction and no longer need to comprise machined parts; instead they may simply consist of cut or cast parts requiring no further finishing.

Figure 15:
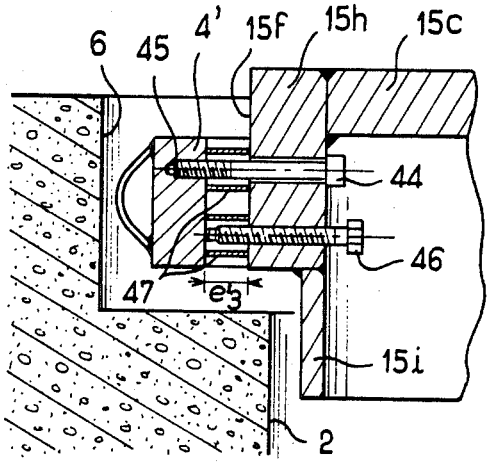
FIGS. 15 and 16 show, to a larger scale than that of FIG. 2, another form of the lower part of the jig that is used to implement the method of the present invention when the sealing ring of the pump has a cylindrical shape.

In the foregoing description the sealing ring 8 was in the shape of a flat ring. In some cases, however, the sealing ring is cylindrical and surrounds the lower part 14*a* of the rotor 14 of the pump concentrically, with a small radial clearance. In this case the lower part of the jig 15 may be modified as shown in FIG. 15. To the edge of the flange 15*c* is welded a cylindrical ring 15*h* coaxial with the axis 16 of the jig 15 (FIG. 2) and which has an outside diameter equal to the outside diameter of the sealing ring. The outside cylindrical surface of the ring 15*h* forms the molding surface 15*f*. The ring 15*h* is extended downwardly by a cylindrical skirt 15*i* which has an outside diameter slightly smaller than the inside diameter of the suction orifice 2 of the volute. The ring 4' of the pump is also of cylindrical shape and is removably attached to the ring 15*h* of the jig by tension screws such as the screw 44 shown in FIG. 15, that are screwed into threaded holes 45 in the ring 4'. A gap $e_3$ is provided between the rings 4' and the ring 15*h* by thrust screws such as the screw 46 shown in FIG. 15, there being three thrust screws spaced at angles of 120°, for example. Sealing rings 47 are placed around each of the screws 44 and 46. The rings 47 placed around the screws 44 may also serve as spacing rings, in which case the thrust screws 46 may be dispensed with.

Figure 16:
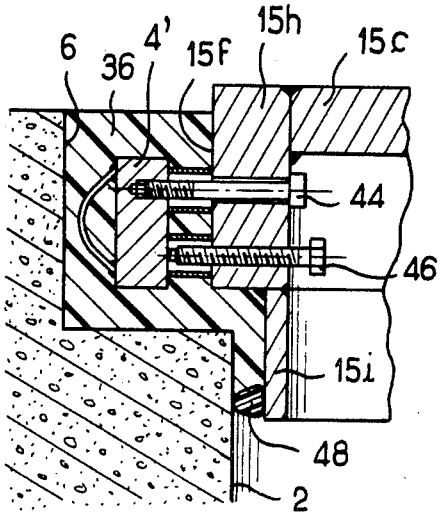
Figure 17:
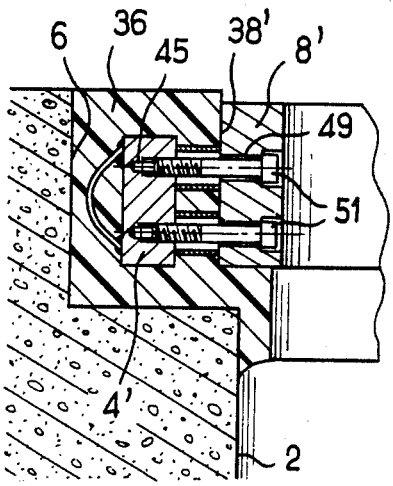
FIG. 17 is a view similar to FIGS. 15 and 16 showing the cylindrical sealing ring fixed to the lower ring of the pump.

After the jig has been positioned relative to the volute 1 as in the embodiment described above, a sealing bead 48 is placed between the cylindrical skirt 15*i* and the suction orifice 2 as shown in FIG. 16. A resin 36, for example the CHOCKFAST ORANGE resin previously mentioned, is then cast in the recess 6 in order to embed completely the ring 4'. At the same time the upper ring 5 of the pump is embedded in the way previously described. When the resin 36 has hardened, the screws 44 and 46 are removed and the jig 15 is lifted out through the well 3 of the volute as in the embodiment previously described. Removal of the mold leaves a cylindrical molded surface 38' (FIG. 17) adapted to receive the cylindrical sealing ring 8'. This comprises holes 49 that are aligned with the threaded holes 45 in the ring 4' and into which are inserted screws 51 for fixing the sealing ring 8' to the ring 4'.

It is to be understood that the embodiments described hereinabove have been given by way of illustrative and non-limiting example only and that numerous modifications may readily be proposed by those skilled in the art without departing from the scope of the present invention.

I claim

1. Method of interfacing mechanical and concrete components of a pump comprising a concrete volute having an axial suction orifice in its lower part and a well in its upper part substantially coaxial with said suction orifice, coaxial upper and lower metal rings, which are fixed in respective recesses provided in the concrete of said well and of said suction orifice, a sealing ring removably attached to said lower ring, a metal cover having an edge removably attached to said upper ring, a vertical shaft supported axially and rotatably mounted on said cover, and a rotor attached to a lower end of said shaft and having a part facing said sealing ring with a small clearance between them, in which method said upper and lower rings are placed simultaneously in the respective recess, each ring is encapsulated with a hardenable resin which is shaped by means of a single mold having upper and lower molding surfaces coaxial with and spaced from each other at an axial distance corresponding to the vertical distance between said edge of said cover and said sealing ring so as to form, once said resin has set, upper and lower annular blocks or resin reinforced by said metal rings and having molded surfaces corresponding to said molding surfaces of said mold and respectively serving to support said cover and said sealing ring.

2. Method according to claim 1, wherein, for placing the upper and lower rings in the respective recesses and for casting the resin, use is made of a jig comprising upper and lower molding surfaces, said rings are removably attached to the upper and lower molding surfaces of said jig, leaving a gap between each of said rings and the molding surface associated with it, said jig together with said rings is inserted into said well of said volute, the position and the level of said jig are adjusted relative to said volute so that said rings are coaxial with the axis of said volute and are level with said recesses, said resin is cast in said recesses and in the spaces between said molding surfaces and said rings, and - after said resin has hardened - said jig is detached from said rings and withdrawn from said well, after which said sealing ring is fixed to said lower ring, said rotor, said shaft and said cover are inserted into said volute, and said cover is fixed to said upper ring.

3. Method according to claim 2, wherein said jig is substantially cylindrical and comprises in its upper part an annular flange the lower surface of which constitutes said upper molding surface and, in the situation where said sealing ring is in the form of a flat rings, said jig comprises in its lower part another annular flange and the lower surface of which constitutes said lower molding surface.

4. Method according to claim 2, wherein said jig is substantially cylindrical and comprises in its upper part an annular flange the lower surface of which constitutes said upper molding surface and, in the situation said upper molding surface and, in the situation where said sealing ring is cylindrical, said jig comprises in its lower part a cylindrical part the outside surface of which constitutes said lower molding surface.

5. Method according to claim 3, wherein said resin is cast in said recesses and in said spaces in two stages, a resin mortar being cast in a first stage into said recesses up to a level such that said metal rings are at least partially embedded in said resin mortar, and in a second stage, after said resin mortar has set, a hardenable resin is cast so as to fill completely the space between said resin mortar and said molding surfaces of said jig.

6. Pump comprising a concrete volute having an axial suction orifice in its lower part and a well in its upper part substantially coaxial with said suction orifice, coaxial upper and lower metal rings, which are fixed in respective recesses provided in the concrete of said well and of said suction orifice, a sealing ring removably attached to said lower ring, a metal cover having an edge removably attached to said upper ring, a vertical shaft supported axially and rotatably mounted on said cover, a rotor attached to a lower end of said shaft and having a part facing said sealing ring with a small clearance between them, and respective annular blocks of resin cast in each recess, each block encapsulating the respective metal ring and having a respective molded surface supporting said sealing ring, and said cover, respectively.

* * * * *